United States Patent [19]

Egan

[11] Patent Number: 4,874,272

[45] Date of Patent: Oct. 17, 1989

[54] CANTILEVER RETAINING WALL SYSTEM USING DISCRETE PRECAST FACING PANELS

[75] Inventor: Philip D. Egan, Great Falls, Va.

[73] Assignee: The Reinforced Earth Comany, Arlington, Va.

[21] Appl. No.: 117,845

[22] Filed: Nov. 9, 1987

[51] Int. Cl.[4] ..... E02D 29/00

[52] U.S. Cl. ..... 405/284; 405/258; 405/286

[58] Field of Search ..... 405/262, 284, 286, 258, 405/285, 272

[56] References Cited

U.S. PATENT DOCUMENTS

| | | | |
|---|---|---|---|
| 1,761,614 | 6/1930 | Collier | 405/286 |
| 3,250,075 | 5/1966 | Webb et al. | 405/262 |
| 3,464,211 | 9/1969 | Andresen | 405/262 |
| 4,616,959 | 10/1986 | Hilfiker | 405/286 |
| 4,653,962 | 3/1987 | McKittrick et al. | 405/262 X |
| 4,728,225 | 3/1988 | Brandl et al. | 405/262 |

FOREIGN PATENT DOCUMENTS

| | | | |
|---|---|---|---|
| 2030854 | 1/1972 | Fed. Rep. of Germany | 405/284 |
| 386800 | 1/1933 | United Kingdom | 405/284 |

*Primary Examiner*—Dennis L. Taylor

*Attorney, Agent, or Firm*—Allegretti & Witcoff, Ltd.

[57] ABSTRACT

An improved cantilever retaining wall is comprised of a combination of precast wall panels that are interconnected in a pattern to form a planar vertical wall structure for supporting fill. Each of the wall panels includes a preform on one side thereof. Various preforms are aligned when the panels are erected for receipt of a cast in place or precast vertical beam member. In a preferred embodiment, a structural footing is provided for support of the panels.

4 Claims, 6 Drawing Sheets

CANTILEVER RETAINING WALL SYSTEM USING DISCRETE PRECAST FACING PANELS

BACKGROUND OF THE INVENTION

This invention relates to an improved retaining wall construction and, more particularly, to a cantilever-type retaining wall construction fabricated from cast in place components and precast components in combination.

A cast in place cantilever wall is a well known civil engineering structure. Typically such a wall is formed by removing earth at the situs where the wall will be positioned. A large base of reinforced concrete in the form of a horizontal shelf or platform is then cast in place along with a vertically upward extension from the horizontal platform. Fill and other material is then placed behind the cast in place structure. Various permutations and combinations of this construction are known There has remained, however, the need to provide an improved cantilever-type wall, particularly one where a minimum amount of on-site casting is required. The present invention provides such a structure.

SUMMARY OF THE INVENTION

Briefly the present invention comprises an improved cantilever retaining wall which is comprised of a combination of preformed wall panels that are interconnected in a mosaic or pattern to form a planar vertical wall structure for supporting fill. Each of the wall panels includes a preform on one side thereof. The preforms are aligned vertically when the panels are erected for receipt of a cast in place or prefabricated vertical beam member. In a preferred embodiment, a structural footing is provided for support of the panels.

Thus, it is an object of the invention to provide an improved cantilever wall construction.

A further object of the invention is to provide an improved cantilever wall construction comprised of a plurality of precast panels which cooperate with a vertical cantilever beam extending from a cantilever pad. Alternatively, the beam extends into the earth to define a support for the panels.

Yet another object of the invention is to provide a method for fabricating a cantilever wall construction utilizing precast panels.

Still a further object of the invention is to provide a cantilever wall and which is fabricated from component parts that are easily movable to a construction site.

Another object of the invention is to provide an embodiment which may constitute a gravity structure. Such an embodiment comprises a wall system wherein separate panels are precast and positioned on compacted soil without a footing. Preforms incorporated in the panels can then be filled with concrete or compacted soil to complete the gravity wall system.

These and other objects, advantages and features of the invention will be set forth in the detailed description which follows.

DESCRIPTION OF THE PREFERRED EMBODIMENT

Figure 1:
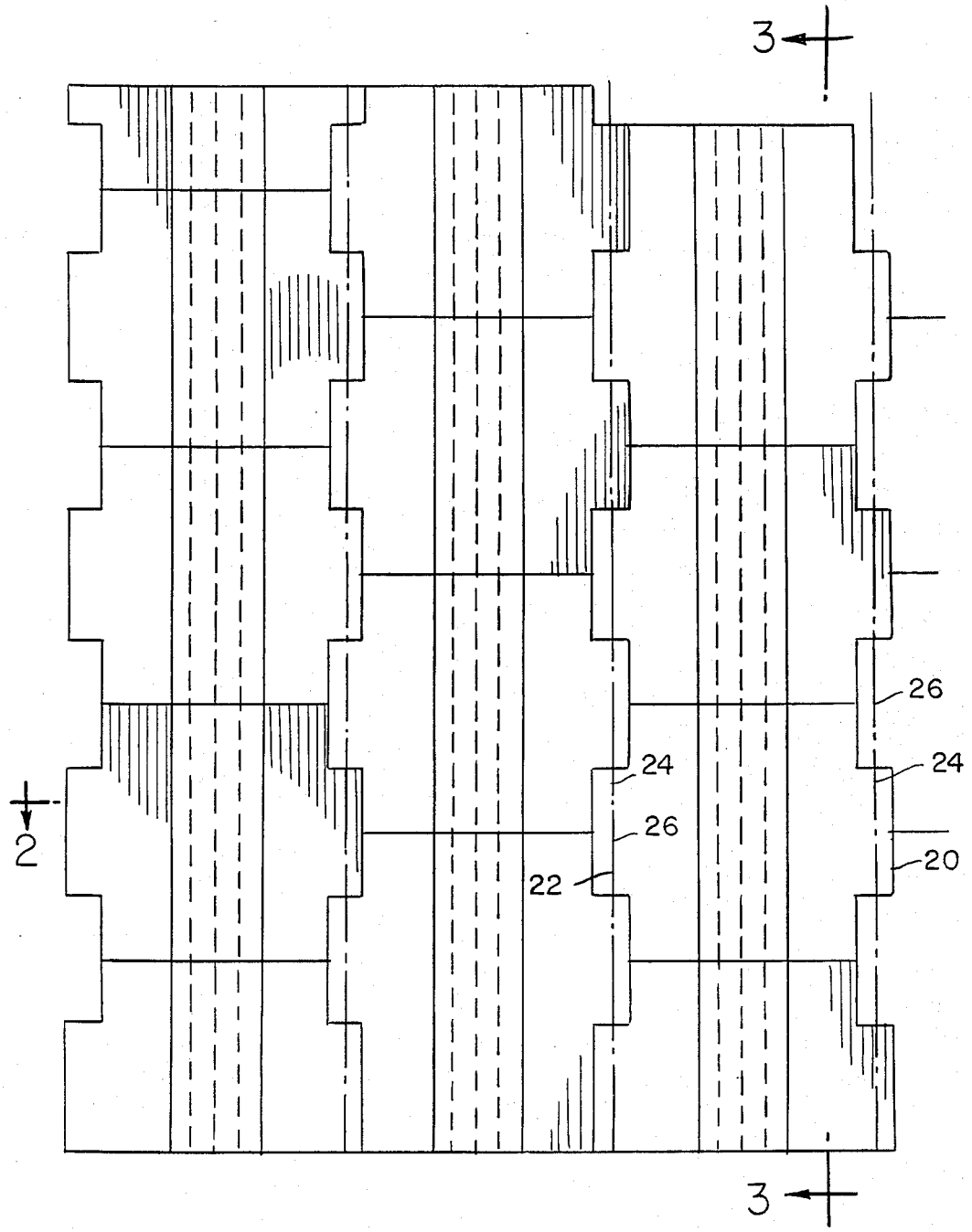
FIG. 1 is a front plan view of a first embodiment of the improved cantilevered wall construction of the present invention.

The cantilever wall of the invention utilizes, in all instances, a plurality of precast or preformed front panels 10. The precast front panels 10 may have the shape of a cruciform as shown in FIG. 1. However, this shape is not a limiting feature of the invention. That is, front panel 10 may be rectangular in shape, hexagonal or any other form which, in combination, can be erected or stacked to form a mosaic or pattern that will define a total and complete vertical wall.

The panels 10 thus may be generally planar or may have a curved shape. In each instance, however, each panel 10 includes a back surface 12 and front surface 13. Panel 10 also includes means, i.e. a preform 16, preferably on its back surface 12, to receive a vertical cantilever beam which is either cast in place or alternatively prefabricated and thereafter connected to the panel 10. This will be described in greater detail below.

The panels 10 are in all instances a structural element of the cantilever wall inasmuch as they must retain soil or earth. Thus, there are lateral stresses on the wall panels 10. The panels 10 are therefore of sufficient integrity and strength so as to support such stresses.

Preferably the panels 10 are fabricated from reinforced concrete, i.e. concrete with steel reinforcing bars 17 cast therein. However, the material for the manufacture of the panels 10 is not a limiting feature. For example, panels 10 may be of wood, metal or plastic material.

Figure 2:
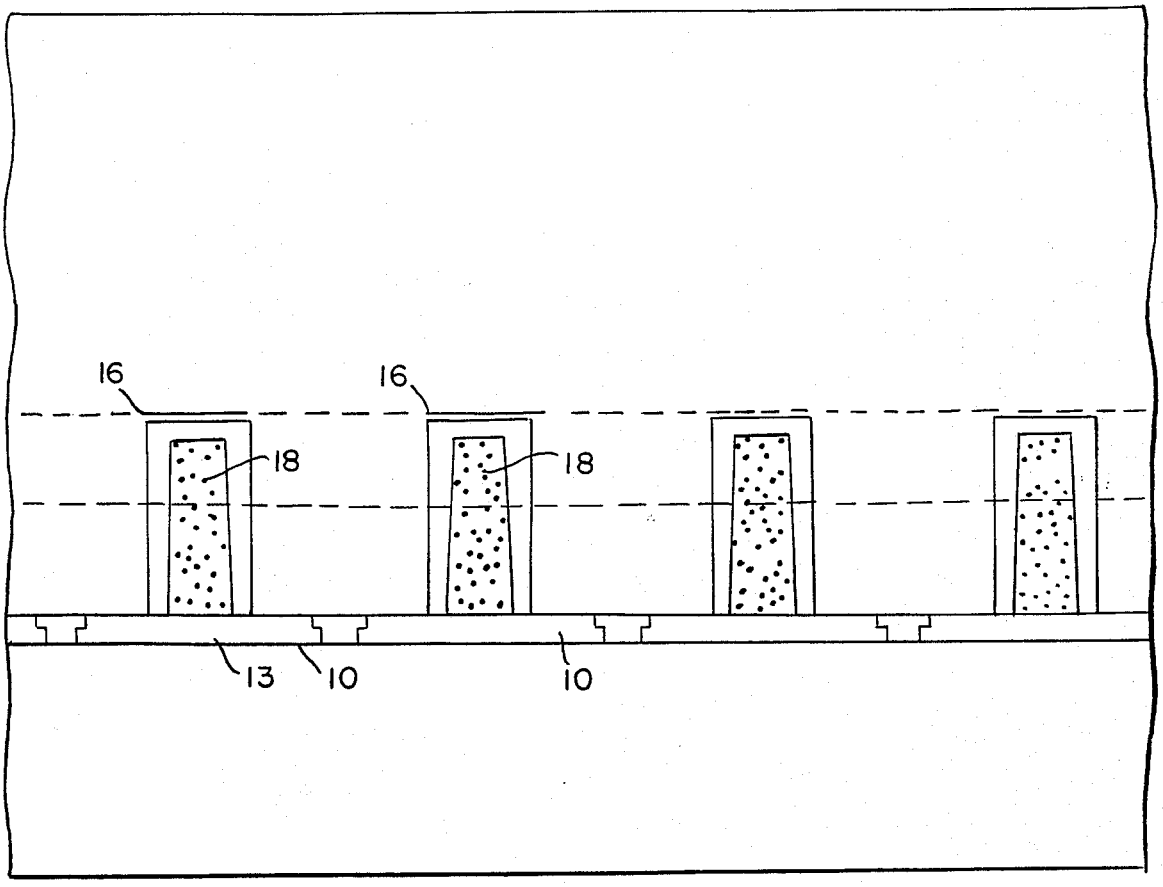
FIG. 2 is a top cross section of the wall of FIG. 1 taken substantially along the line 2—2.

The cantilever wall construction is comprised of the panels 10 which are supported on a footing 14 that is generally horizontal. Footing 14 extends from a position in front of the wall defined by panels 10 as shown in FIG. 2 to a position covered by a significant amount of earth or soil which is being retained. Calculation of the dimensions of the cantilever footing or platform 14 may be performed by techniques known to those skilled in the art of civil engineering structures and design. The footing 14 is also preferably fabricated from reinforced concrete and cast in place. However, it is possible to precast footing elements in appropriate dimension and thereafter position them on a graded surface in order to form a support for the panels 10 and for vertical beams 18 of the type described in detail below.

As shown in FIG. 2, each of the panels 10 include a preform element 16. The preform element 16 may be fabricated from any desired material such as concrete, steel, plastic or wood. The preform element 16 does not necessarily comprise a structural element of the system or structure. The following description, however, will be directed to the construction of a preform element comprised of precast concrete fabricated with the panel 10 as part of the panel 10. The preform element 16 is a vertical, tubular form, mold designed to define a mold for a vertical cantilever beam 18, which is preferably reinforced. The beam 18 will typically be cast in place, normally in stages. The beam 18, in the final wall, will be under various stresses since the beam 18 is a principal vertical support element for panels 10.

Again the beam 18 is preferably cast in place in order to be adequately and totally connected with the panels 10. However, the beam 18 may be also preformed or precast and embedded in the soil from below the grade of the wall to the top of the wall. In each event, beam 18 provides ultimate support of the wall panels 10.

Preformed beams 18 may be precast or preformed concrete beams or they may constitute some other material such as steel which will be positioned in the preform 16 and somehow attached to the preform 16 to add rigidity to the cantilever wall of the invention.

In review then, the principal elements of the invention are the preformed or precast panels 10; the footing 14, which is preferred but optional and may be precast or cast in place; and the vertical cantilever support beam 18 which is strictly contained by preforms 16 attached to each panel 10. The beams 18 may also be cast in place or precast. In all instances the panels 10 include preforms 16 which serve to define and/or contain vertical, structural beams 18 to the panels 10. The preforms 16 may be formed on the back surface 12 or the forward or front surface 13 of the panels 10. After the components are assembled, the area behind the back surface 12 of the panels 10 is filled with soil or surface which is retained thereby.

Referring again to the first embodiment of FIGS. 1-5, the panel 10 has a modified cruciform shape. Each panel 10 has a thickness of 4 to 8 inches with a reinforcing steel bars 17 precast therein to enhance the strength of the precast panel 10. The panel 10 includes laterally extending wings 20 and 22 with a vertical passage 24 through each wing for receipt of a rod 26. Rod 26 connects vertically adjacent panels 10 keeping those panels 10 properly aligned during the construction process and further enhancing the integrity of the wall.

During construction, the pad or footing 14 is first cast in place on an excavated footing surface. The preform panels 10 are then erected in stages on the footing 14.

In a first embodiment, each preform panel 10 includes a vertical preform cavity 16. The preform cavities 16 of the adjacent, erected vertical panels 10 define a vertical column. After at least one layer or stage of panels 10 is erected, steel reinforcing bars 38 are then positioned within the column. Concrete is then filled within the column to define a structural member having reinforcing bars 38. A vertical column is defined for each vertical set of panels 10 so that every panel is supported by a beam 18.

Figure 4:
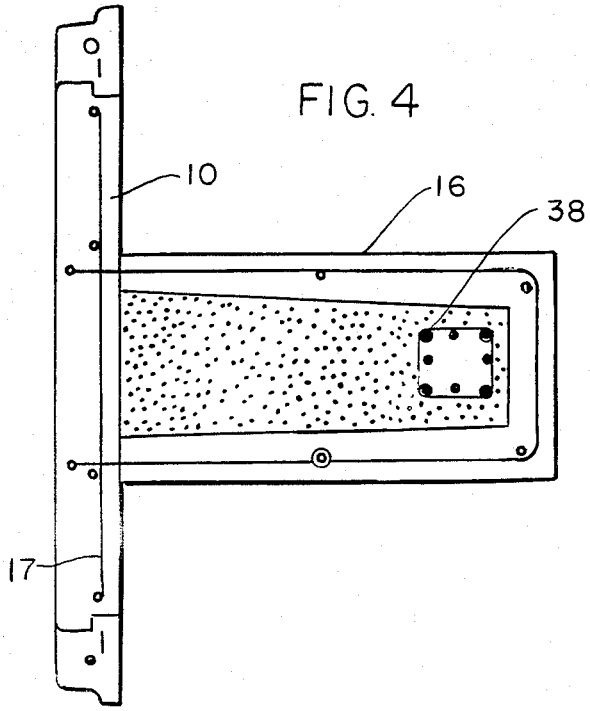
FIG. 4 is a top cross section view of the vertical beam in FIG. 3 taken substantially along the line 4—4.
Figure 3:
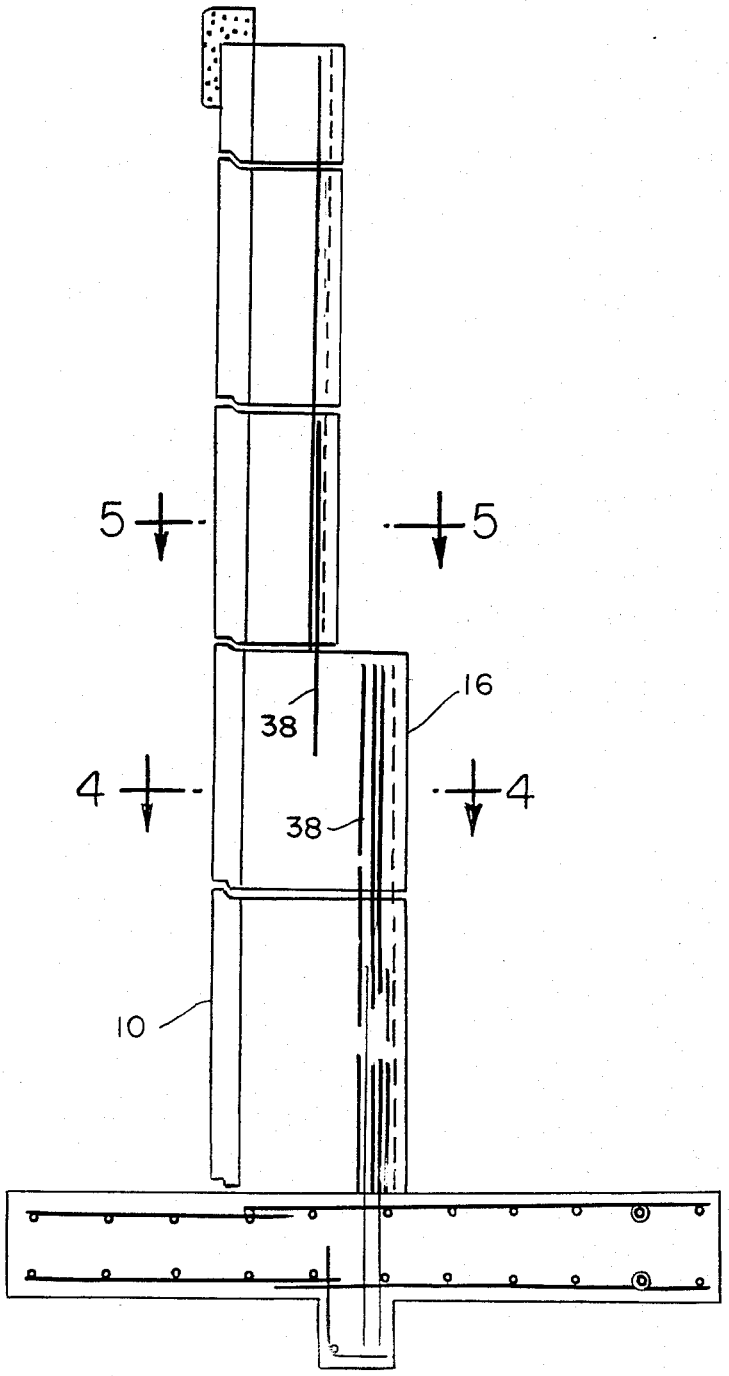
FIG. 3 is a side cross sectional view taken along the line 3—3 in FIG. 1.

The size of the preform column or beam 18 formed by the casting process can be varied. That is, as depicted in FIG. 4, the preform 16 associated with the lower panels 10 has a greater volume and size relative to the preform 16 associated with the upper panels 10. Thus, the structural integrity of the beam 18 formed by the casting process and the strength of the beam 18 can be varied along the height of the wall which is being constructed.

During construction, the beam 18 is formed preferably in stages, the stages being interconnected by reinforcing bars 38 which project from one stage into the next. Typically, after the beams 18 are cast, backfill is positioned behind the panels 10 forming the wall. The stresses on the wall will be such that the reinforcing bars most closely adjacent to the wall panels 10 are in compression whereas those within the beam 18 more distal from the panels 10 are in tension.

Figure 5:
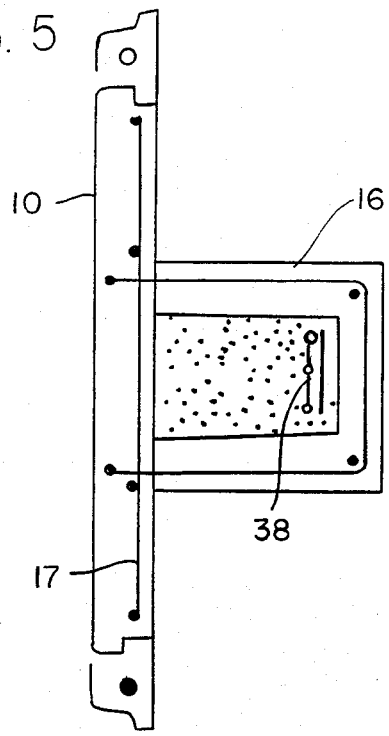
FIG. 5 is a side cross section view of the vertical beam in FIG. 3 taken substantially along the line 5—5.
Figure 7:
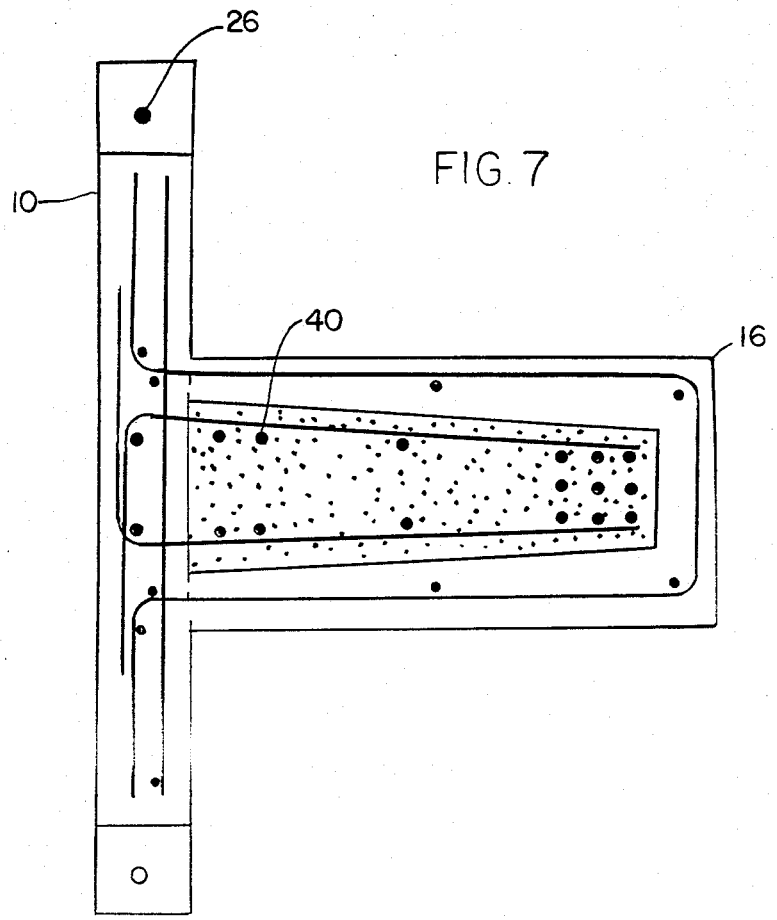
FIG. 7 is a top cross sectional view taken along the line 7—7 in FIG. 6.
Figure 6:
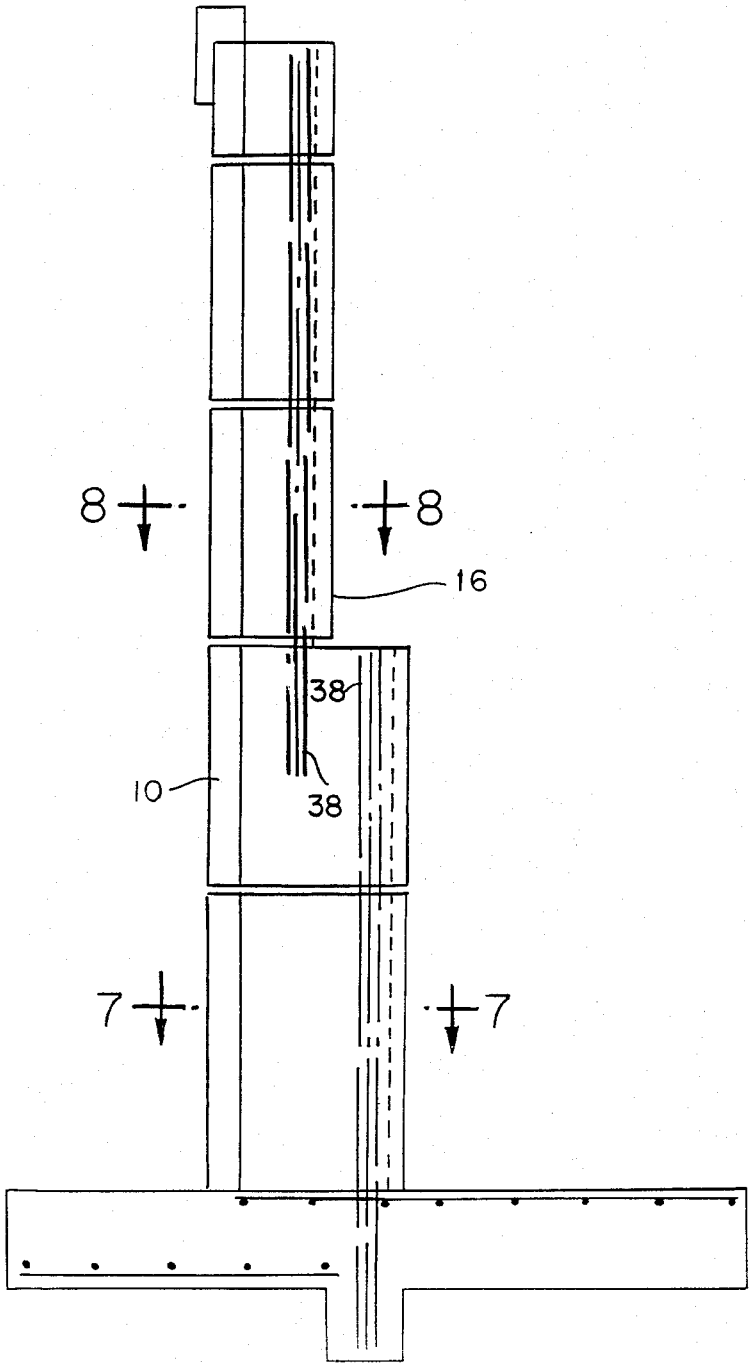
FIG. 6 is a side cross sectional view similar to FIG. 3 of a first alternative cantilever wall construction of the invention.
Figure 8:
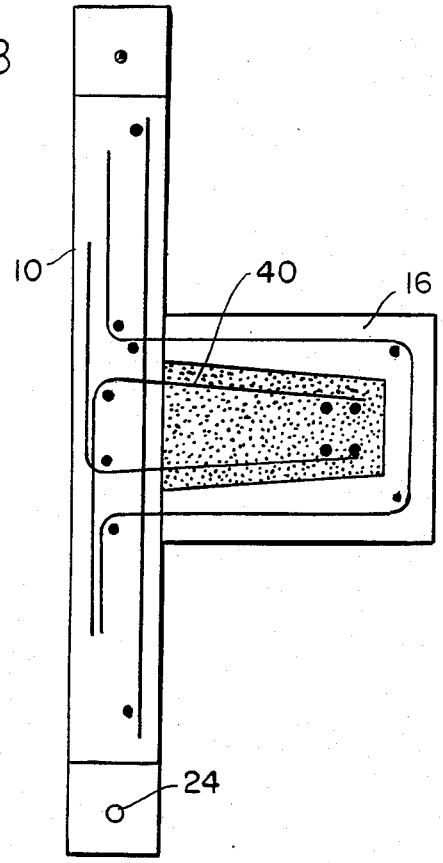
FIG. 8 is a top cross sectional view taken along the line 8—8 in FIG. 6.

FIGS. 6, 7 and 8 disclose an alternative construction wherein the reinforcing bars 40 project from the panel 10 and more particularly from the back surface 12 of the panel 10 into the region of the preform 16. Thus, the reinforcing bars 40 extend horizontally from the panel 10 to further enhance the strength of the beam 18 formed during the casting operation. As shown in FIG. 5, the beam 18, which is cast, preferably projects downwardly into the subsurface below the footing 14.

Figure 9:
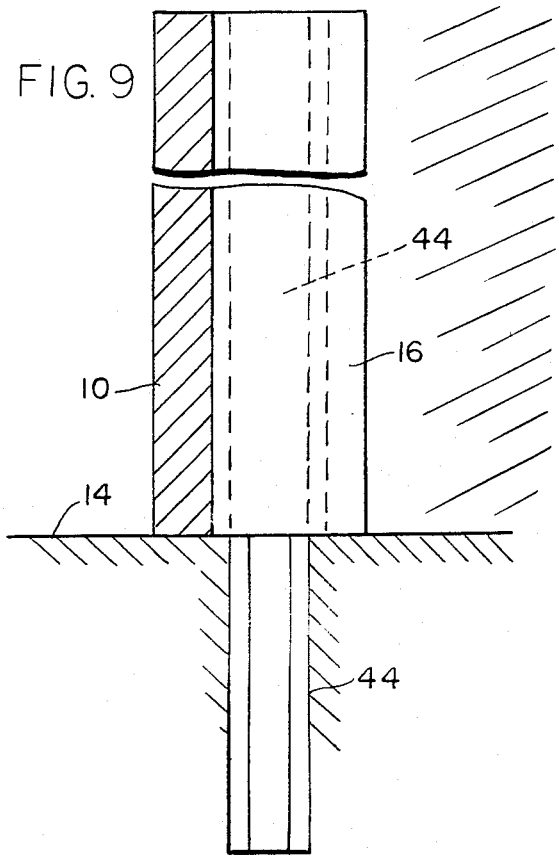
FIG. 9 is a side elevation of a second alternative construction for the cantilever wall of the invention.

FIG. 9 discloses another embodiment wherein prefabricated beams 44 are positioned and recessed into the subsoil below a footing which will support the panels 10. The panels 10 are then fitted over the beams 44 and concrete is poured within the preform 16 about the beam 44 to rigidly attach the beams 44 to the panels 10. The beams 44 may be reinforced concrete beams, steel beams or any other material which ultimately is attached to the specially formed panels 10.

Figure 10:
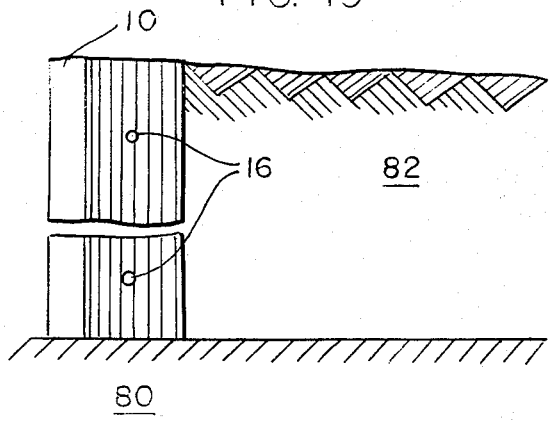
FIG. 10 is a side elevation of a third alternative construction for the cantilever wall of the invention.

In FIG. 10, the panels 10 are placed directly on compacted soil 80. Fill or concrete 82 is placed in preforms 16 defined by the panels 10. Backfill 84 is then placed behind the panels 10. This construction is useful for low walls.

Various permutations of the invention are possible. For example, the preforms 16 may be temporary forms or may be thin sheet forms bolted or otherwise attached to the panels 10. The panels 10 may extend a single course or multiple courses in height. Thus, a retaining wall comprised of a single full height precast panel in combination with prefabricated beams cooperative with a preform can comprise a single system or structure. The panels 10 may interlock to thereby eliminate some of the beams 18. Various interlocking structures for the panels 10 can be provided.

While there has been set forth a preferred embodiment of the invention, it is to be understood that the invention is to limited only by the following claims and their equivalents.

What is claimed is:

1. An improved cantilever type, retaining wall for retention of fill, said wall comprising, in combination:

a plurality of preformed wall panels forming in combination a vertical, generally planar retaining structure for supporting the fill behind said wall panels; said panels defining a repeating mosaic pattern and each panel including a facing portion and in integral, cantilever beam, an enclosed preform projecting from a back side of each panel, said panels arranged in the mosaic with the preforms of vertically adjacent panels aligned to define a preform mold passage extending the height of vertically adjacent panels;

a plurality of vertical beam members aligned at the backside of the wall panels, said members each defining a generally vertical cantilever beam that is cast in place and formed by the preforms;

means for mechanically connecting each of the cast in place beam between adjacent preforms comprising reinforcing members retained within the preform and extending vertically between adjacent preforms prior to forming the cast in place beam; and wall panel fill against the backside of the panels.

2. The wall of claim 1 including a generally horizontal footing, with said beams each connected to and projecting upward from the footing.

3. The wall of claim 1 including a footing which underlies the panels, the cantilever beams and, at least in part, the fill.

4. A method of construction of a cantilever wall comprising the steps of:

forming a generally horizontal footing;

positioning a plurality of discrete preformed wall panels on the footing to define a vertical wall, said panels including integral, enclosed preforms projecting from a face to define a plurality of vertical cantilever beam mold form passages between vertically adjacent panels on the backside of said panels;

casting in place reinforced, vertical cantilever beams in the mold preform passages; and back filling behind the vertical wall.

* * * * *